US006146341A

United States Patent [19]

Sato et al.

[11] Patent Number: 6,146,341

[45] Date of Patent: Nov. 14, 2000

[54] CONTINUOUSLY AND EXTERNALLY DRIVEN MOTION TRAINING DEVICE OF JOINT

[75] Inventors: Takuya Sato; Shigenori Nakamura; Ikuo Otaka, all of Tokyo, Japan

[73] Assignee: M-E-System Inc., Tokyo, Japan

[21] Appl. No.: 09/115,439

[22] Filed: Jul. 15, 1998

[51] Int. Cl.[7] ..... A61H 1/00; A63B 23/14

[52] U.S. Cl. ..... 601/23; 601/5; 601/33; 482/44; 482/45; 482/46

[58] Field of Search ..... 601/5, 23, 33, 601/40; 482/44, 45, 46, 49

[56] References Cited

U.S. PATENT DOCUMENTS

| | | | |
|---|---|---|---|
| 5,170,777 | 12/1992 | Reddy et al. | 128/25 |
| 5,303,696 | 4/1994 | Boice | 601/33 |
| 5,327,882 | 7/1994 | Saringer et al. | 601/40 |
| 5,458,560 | 10/1995 | Kaiser et al. | 601/40 |
| 5,472,410 | 12/1995 | Hammersly | 602/16 |
| 5,620,410 | 4/1997 | Kaiser et al. | 601/40 |
| 5,683,351 | 11/1997 | Kaiser et al. | 601/40 |
| 5,738,636 | 4/1998 | Saringer et al. | 601/5 |

*Primary Examiner*—Richard J. Apley
*Assistant Examiner*—Tam Nguyen
*Attorney, Agent, or Firm*—Michael J. Striker

[57] ABSTRACT

A device for carrying out motional training by continuously flexing and extending a joint of the body comprises a mounting piece for mounting the device in the vicinity of a joint, a drive unit arranged on the mounting piece including a reversable rotation motor having a motor output shaft, a manual switching clutch connected to the motor output shaft, a power transmission connected to the motor output shaft and a transmission output rotating shaft, a swinging arm having a base portion mounted on the mounting piece, and a free end portion of the device including another mounting piece for mounting the free end side of the device to a portion of the shaft body in front of a joint. The swinging arm is coupled to the transmission output rotating shaft and subjected to a reciprocating swing motion during regular and reverse rotation of the transmission output rotating shaft. A movable range setting copying mechanism sets the first swing end and the second swing end of the swing arm. The movable range setting mechanism includes a movable range setting dial located coaxially with the transmission output rotating shaft. A switch is located in the vicinity of the transmission output rotating shaft for controlling the rotational direction of the motor. The movable range settings dial is swung by manually moving the swing arm in a clockwise direction and counterclockwise direction so as to specify the range of motion of each swing.

13 Claims, 10 Drawing Sheets

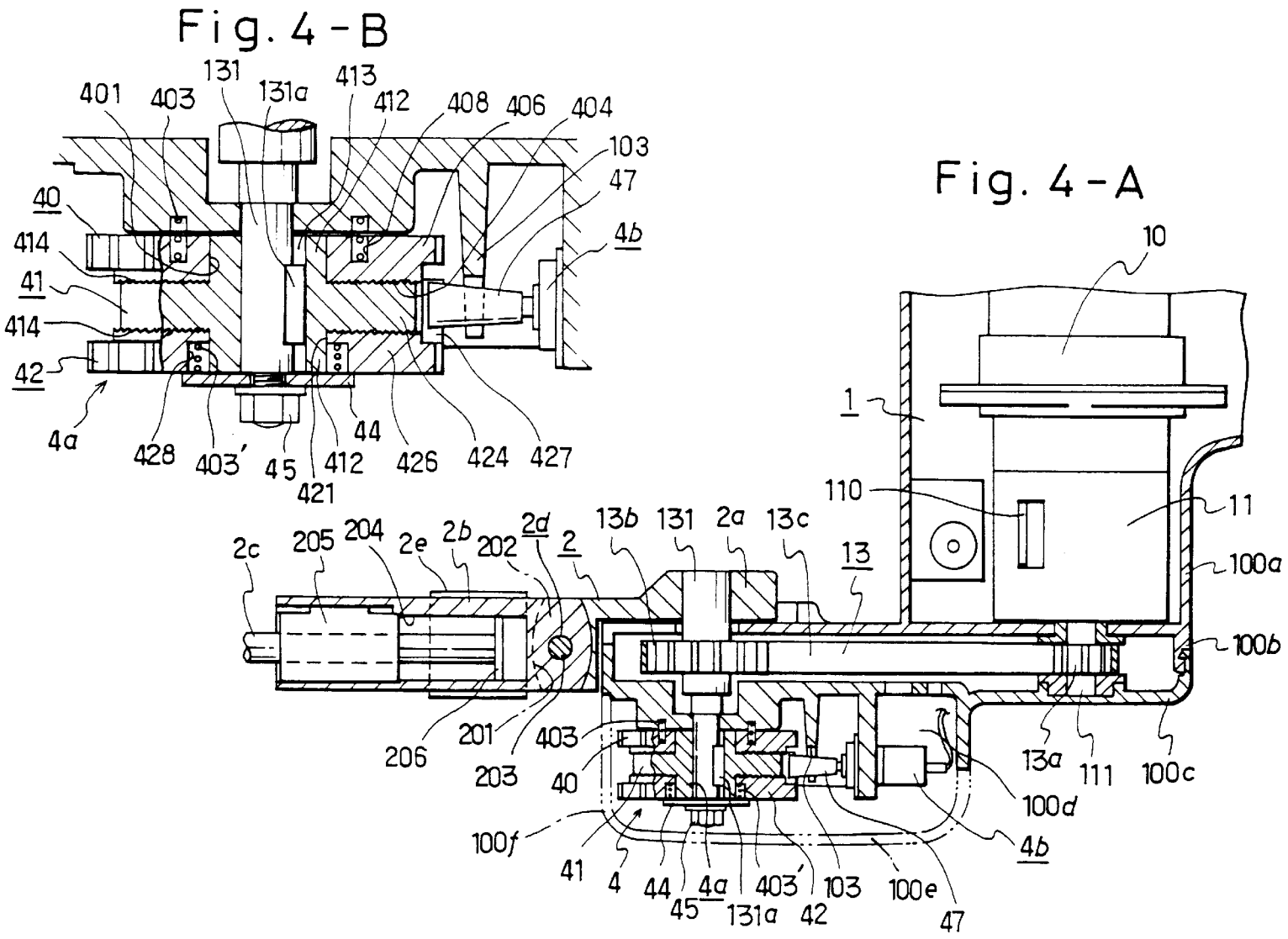
Fig. 4-A
Fig. 4-B
10
11
100a
100b
100c
111
13a
100d
4b
47
100e
103
42
403'
131a
4a
45
44
4
41
100f
1
110
13
13c
2a
131
13b
2
2d
202
2b
2e
204
205
2c
201
203
206
403
40
131
403
401
414
41
414
42
4a
428
421
412
426
424
427
408
406
404
413
44
45

Fig. 7-A
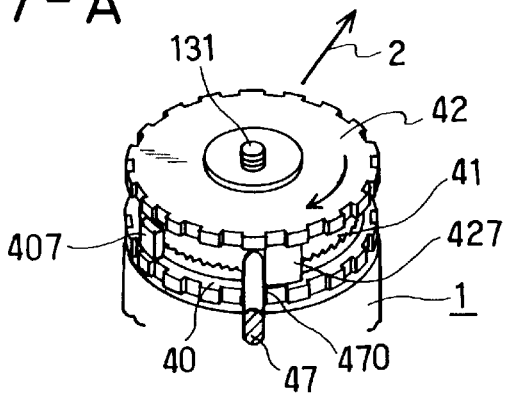
Fig. 7-B
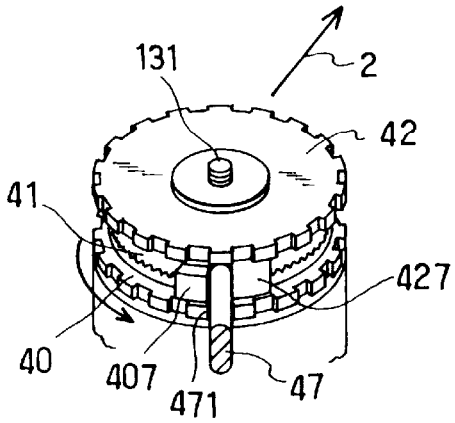
Fig. 7-C
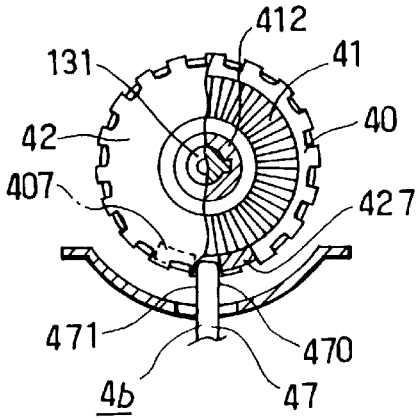
Fig. 7-D
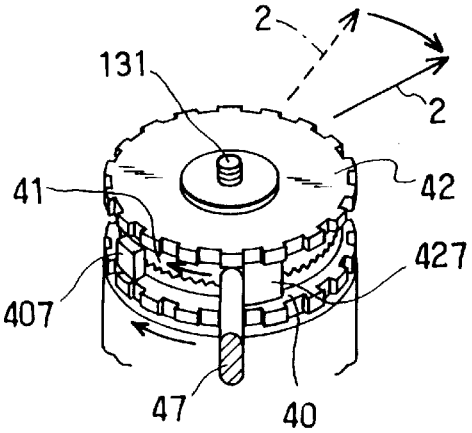
Fig. 7-E
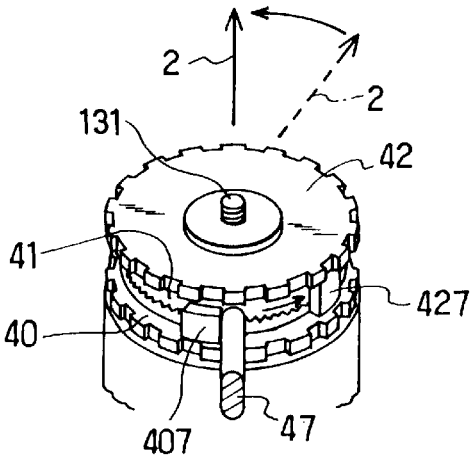

Fig. 8-A
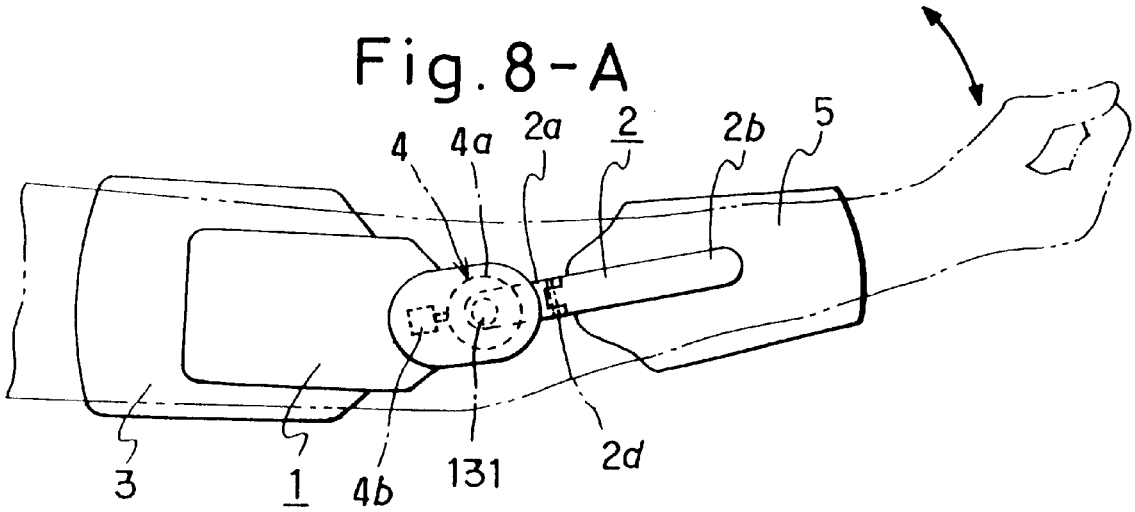
Fig. 8-B
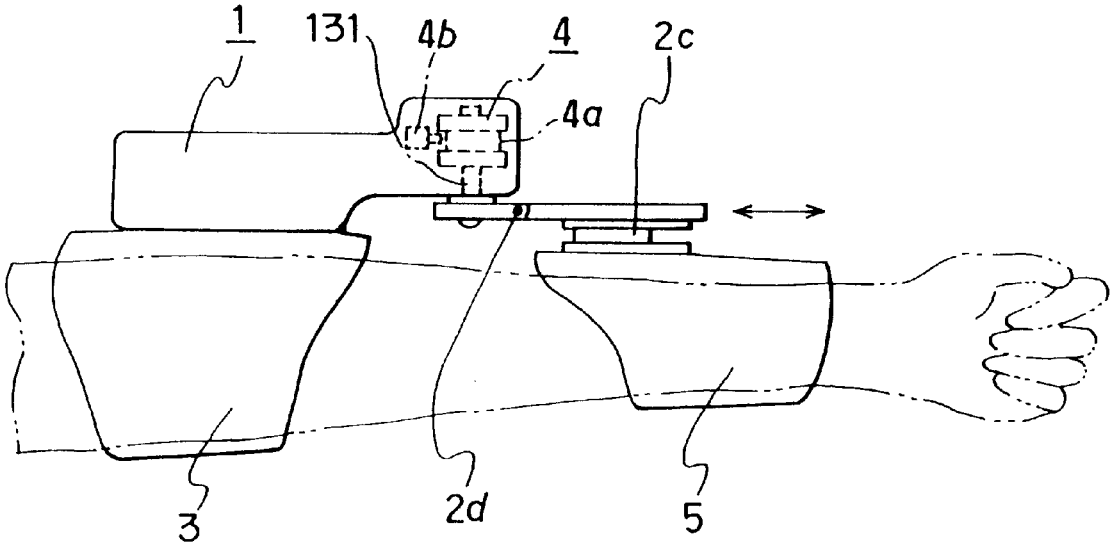

Fig. 9-A
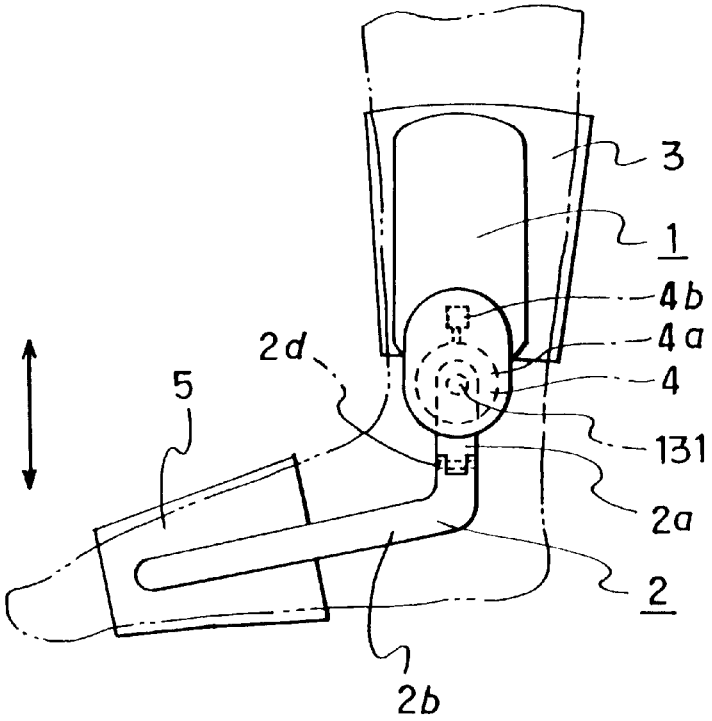
Fig. 9-B
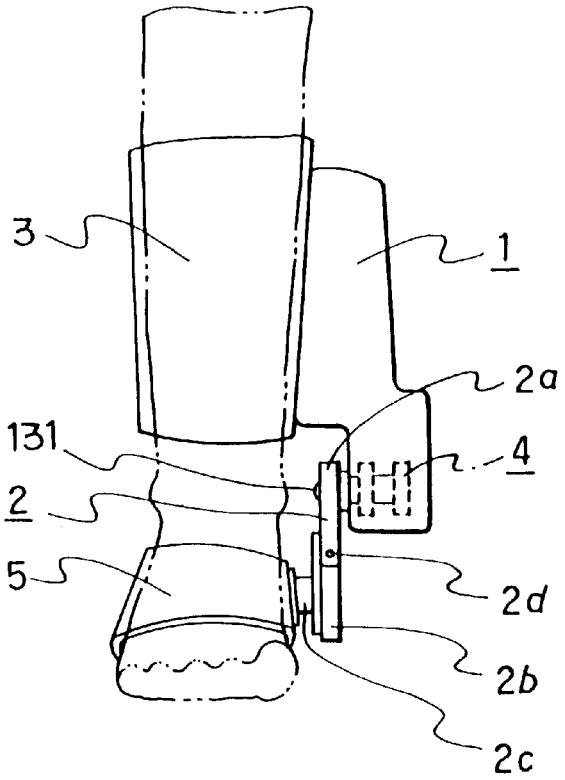

Fig.10-A
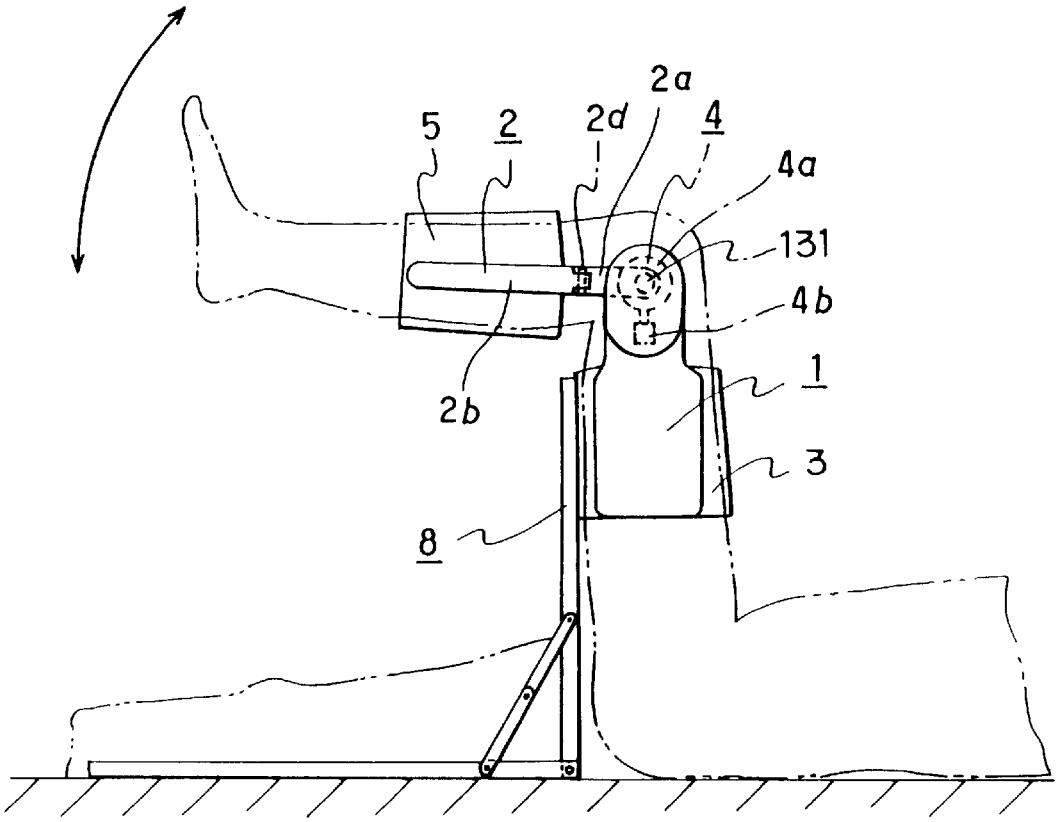
Fig.10-B
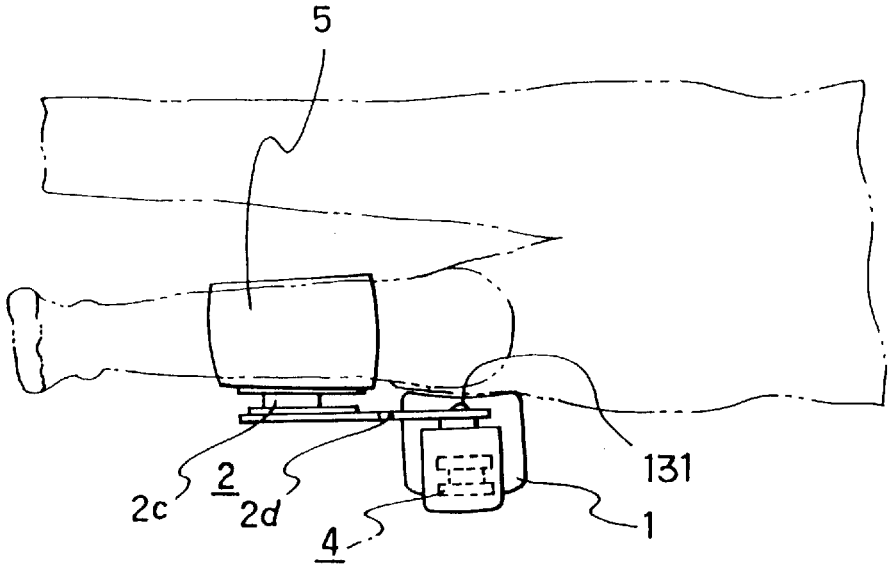

Fig.11-A
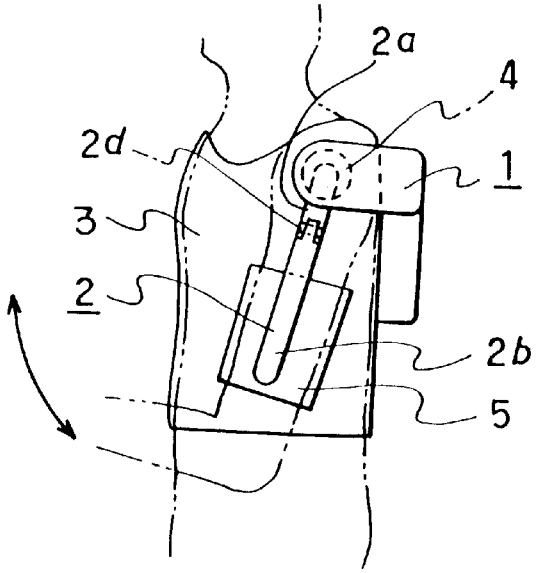
Fig.11-B
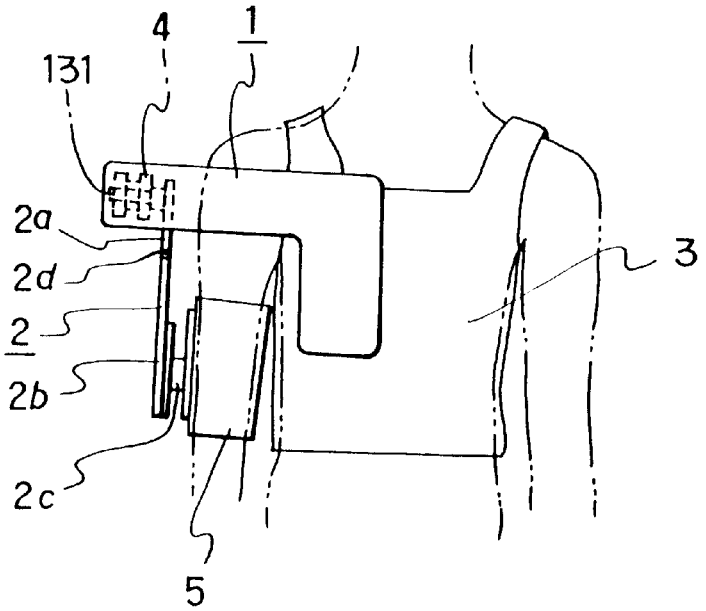

CONTINUOUSLY AND EXTERNALLY DRIVEN MOTION TRAINING DEVICE OF JOINT

BACKGROUND OF THE INVENTION

1. Field of the Invention

The present invention relates to a training device for subjecting a joint, starting from a hand joint, to continuous flexion and extension motions.

2. Description of Related Art

In the case of fracture or operation of a joint, it is important to ensure that a movable region of a joint at an early stage, avoids extra-articular contracture and to alleviate tumefaction or pain after operation. As a method of rehabilitation therefor, conventionally a continuously and externally driven motion training of a joint has been used.

In is preferable to carry out the training of a joint under continuously and externally driven motions by a proper motional amount necessary for training without exerting unreasonable force on organism of a patient. In particular, the motion of a joint is not a uniaxial but a multiaxial rotary compound motion, so a feasible motional amount is not uniform and possesses considerable individual differences. Thus, the proper amount of motion considerably reflects an individual and the symptom of that individual.

Accordingly in a device for such a training, a drive motor is installed on a mounting piece for mounting the device at a location in the vicinity of a joint, a swing arm is installed on a mounting piece or a grip for mounting to a free end side of a front portion of a joint, and the swing arm is reciprocated by the drive motor. However, in the conventional device of this kind, in respect of a motional range for training, a swing angle of the swing arm can only be mechanically sets such that a swing angle of a flexing side is set to 0 through $\alpha°$ and that of an extending side is set to 0 through $\beta°$ by an angle setting dial regardless of what degree of a feasible motional range is actually provided to a patient.

Therefore, when continuously and externally driven motion for training of a joint is actually carried out, it is necessary to operate a swing arm to gradually widen a movable angular range. The swing arm is operated by setting it firstly to a narrow movable angular range, and if a patient does not suffer pain in that range, the setting is changed to a pertinently wider movable angular range and the swing arm is operated again. Accordingly, this poses a problem in that much time and labor is needed until a proper motional range is set and a patient may suffer pain by setting an excessive angle.

Further, in a conventional device, there is a problem that a swing arm can carry out only a simple uniaxial swing motion and therefore, the motion does not match with the actual motion of a joint and extra stress is imposed on the affected part.

SUMMARY OF THE INVENTION

Hence, it is an object of the present invention to provide a device capable of setting a motional range extremely simply, swiftly and accurately, and also capable of carrying out continuously and externally driven motion of a joint by a motional amount which is necessary for training and is proper without effecting pain on a patient.

It is another object of the invention to provide a device capable of carrying out a continuously and externally driven motion of a joint in without exerting unreasonable force on the affected part.

In order to achieve the above-described objects, according to one aspect of the present invention, a continuously and externally driven motion training device of a joint has a mounting piece for mounting the device at a portion in a vicinity of the joint, a drive unit mounted to the mounting piece, a swing arm with a base portion side mounted to the mounting piece and provided with another mounting piece in respect of a portion of a front portion of the joint, and a movable range setting copying mechanism of the swing arm.

The drive unit mentioned above is provided with a motor of a reversible rotational type, a clutch of a manual switching type is connected to an output shaft of the motor, a power transmitting means is connected to an output shaft of the clutch, and the swing arm is coupled to a rotating shaft on an output side of the power transmitting means and is subjected to a reciprocating swing motion by regularly and reversely rotating the rotating shaft.

The movable range setting copying mechanism is provided with a movable range setting dial attached coaxially with the rotating shaft, and a switch disposed in a region at a vicinity of the rotating shaft for controlling a reverse of a direction of driving the motor By moving the swing arm manually in the clockwise direction and in the anticlockwise direction, the movable range setting dial is swung to specify desired ranges.

According to one aspect of the present invention, when the mounting pieces are attached to the affected part, then by simple operation of only bending directly a joint of a patient by an operator, an optimum and accurate movable range of the swing arm is set automatically and in compliance with the state of the patient. Further, by starting the motor, the reciprocating swing motion of the swing arm is reproduced in the movable range and accordingly, pertinent continuous motional training of the joint can be carried out efficiently and without effecting pain on the patient.

The movable range setting dial includes a fixing dial integrally rotated with the rotating shaft, a first movable dial and a second movable dial both attached to the fixing dial rotatably relative to the fixing dial and the first movable dial and the second movable dial are disposed in laminated layers interposing the fixing dial. The switch is fixedly arranged at a vicinity of the movable range setting dial and is provided with a lever extending toward the movable range setting dial at its front end. Each of the first movable dial and the second movable dial is provided with a dog portion which can be brought into contact with the lever of the switch at a portion thereof.

When such a construction is adopted, an excellent effect is achieved in that the setting of the movable range and copying operation can be realized by a simple and compact structure.

Further, the device of the present invention is preferably provided with a slider portion by which the swing arm is movable in the direction of the axial line, and the mounting piece is connected to the slider portion. Accordingly, even when a relative shift is caused between the joint of the patient and the position of the rotating shaft, the motional training of the joint can be carried out smoothly.

Further, according to the present invention, preferably, the swing arm is provided with a base portion axially attached to the rotating shaft, a main portion is connected to the base portion by a hinge mechanism flexibly in a direction orthogonal to the swing faces and the slider portion held by the main portion slidably in the direction of the axial line. Accordingly, an excellent effect is achieved in that the multiaxial rotary compound motion corresponding to the axial motion of a joint can be reproduced and motional training can be carried out without effecting pain on a patient.

Further, the present invention is applicable to a continuous flexion and extension motion training device for of a desired joint, which in not only a hand joint but also an elbow joint, an ankle joint, a knee joint, a shoulder joint, a hip joint and so on.

Although other characteristics and advantages of the present invention will become apparent by the following detailed description, the present invention is not limited to constructions shown by embodiments so far as basic characteristics of the present invention are provided and it is apparent that a skilled person can make various changes as well as modifications without deviating from the scope of the present invention.

BRIEF DESCRIPTION OF THE DRAWINGS

FIG. 4-A is a longitudinal side sectional view enlarging essential portions of the device in accordance with the first embodiment of the present invention;

FIG. 4-B is a view partially enlarging the view of FIG. 4-A;

FIG. 7-A is a perspective view showing a first stage of setting an origin point of the movable range setting copying mechanism FIG. 7-B is a perspective view showing the original point setting state (second stage) of the same;

FIG. 7-C is a partially cut longitudinal sectional view of FIG. 7-B;

FIG. 7-D is a perspective view showing a state in which a second swing end is set by moving a swing arm, FIG. 7-E is a perspective view showing a state in which a first swing end is set by moving the swing arm;

FIG. 8-A is a side view showing a state of using a continuously and externally driven motion training device in accordance with a second embodiment of the present invention for an elbow joint;

FIG. 8-B is a plane view of FIG. 8-A;

FIG. 9-A is a side view showing a state of using a continuously and externally driven motion training device in accordance with a third embodiment of the present invention for an ankle joint;

FIG. 9-B is a front view of the same;

FIG. 10-A is a side view showing a state of using a continuously and externally driven motion training device in accordance with a fourth embodiment of the present invention for a knee joint:

FIG. 10-B is a plane view of the same;

FIG. 11-A is a side view showing a state of using a continuously and externally driven motion training device in accordance with a fifth embodiment of the present invention for a shoulder joint;

FIG. 11-B is a front view of the same; and

DETAILED DESCRIPTION OF THE PREFERRED EMBODIMENT

Figure 12:
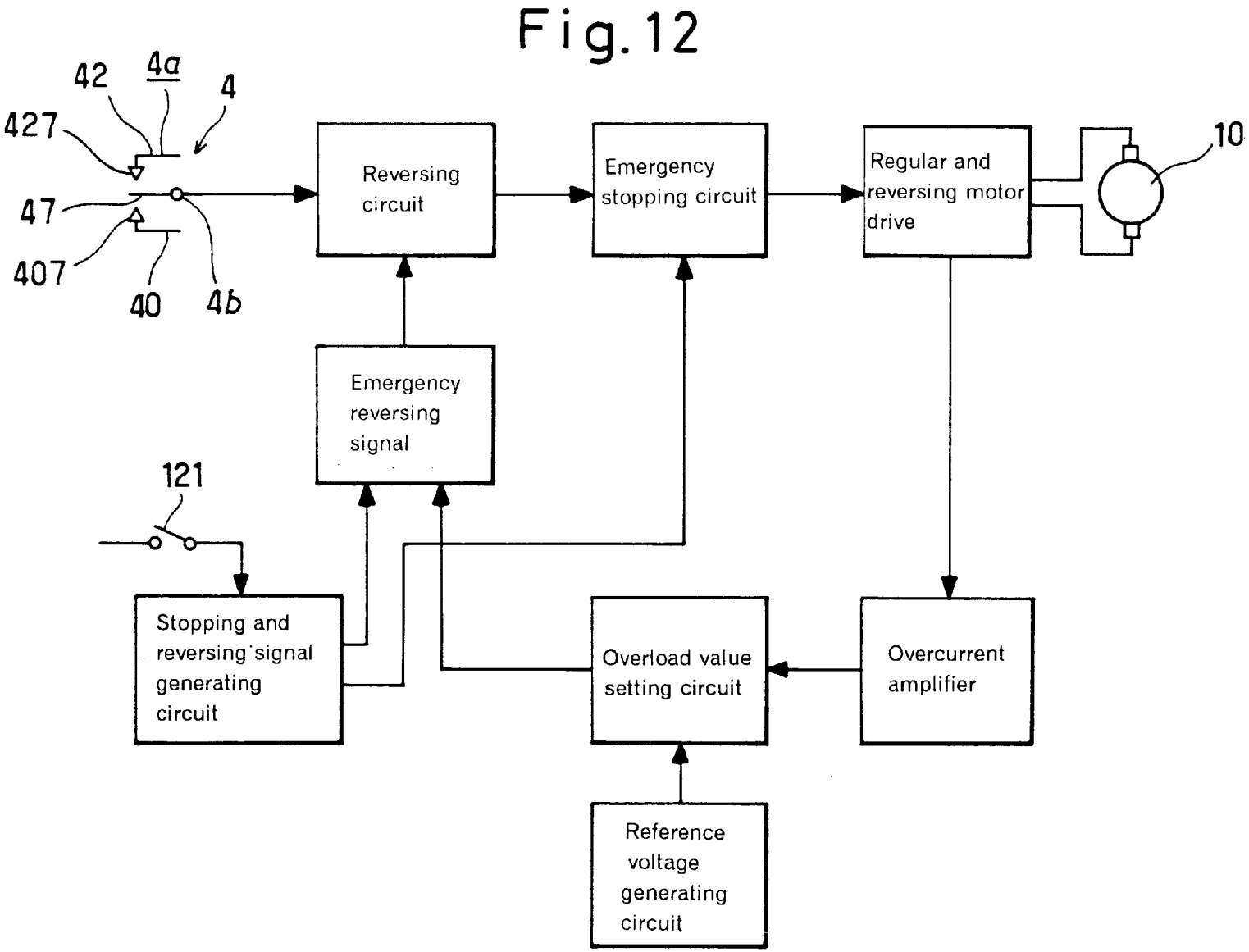
FIG. 12 is a block diagram of a drive system according to the present invention.

FIGS. 1, 2, 3, 4-A, 4-B, 5, 6, 7-A, 7-B, 7-C, 7-D and 7E show a device in accordance with an embodiment (referred to as first embodiment) in which the present invention is applied to a continuously and externally driven motion training device for a hand joint. FIG. 12 is a block diagram of essential portions.

Figure 1:
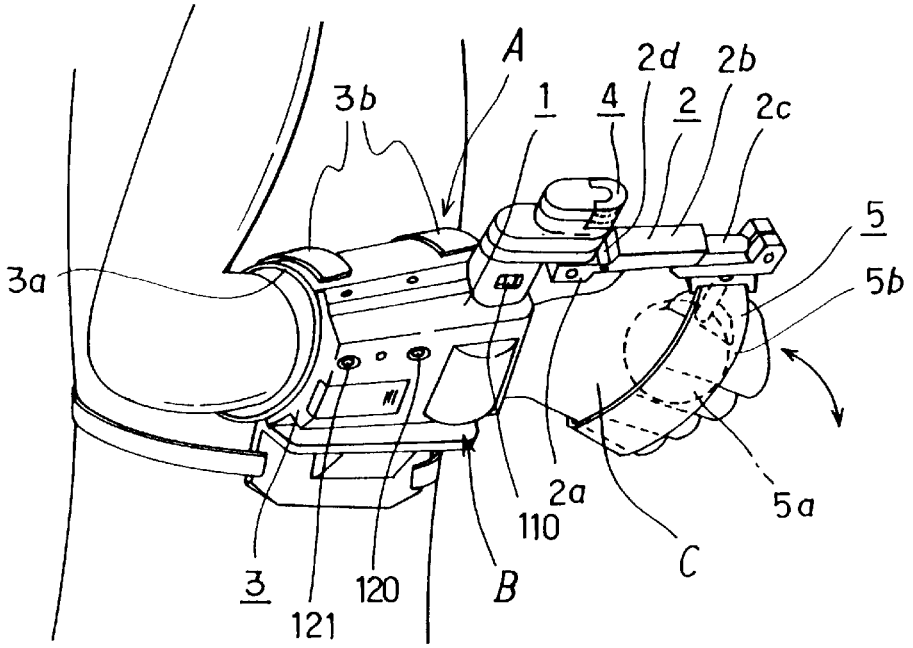
FIG. 1 is a perspective view showing a state of using a continuously and externally driven motion training device of a hand joint in accordance with a first embodiment of the present invention.
Figure 2:
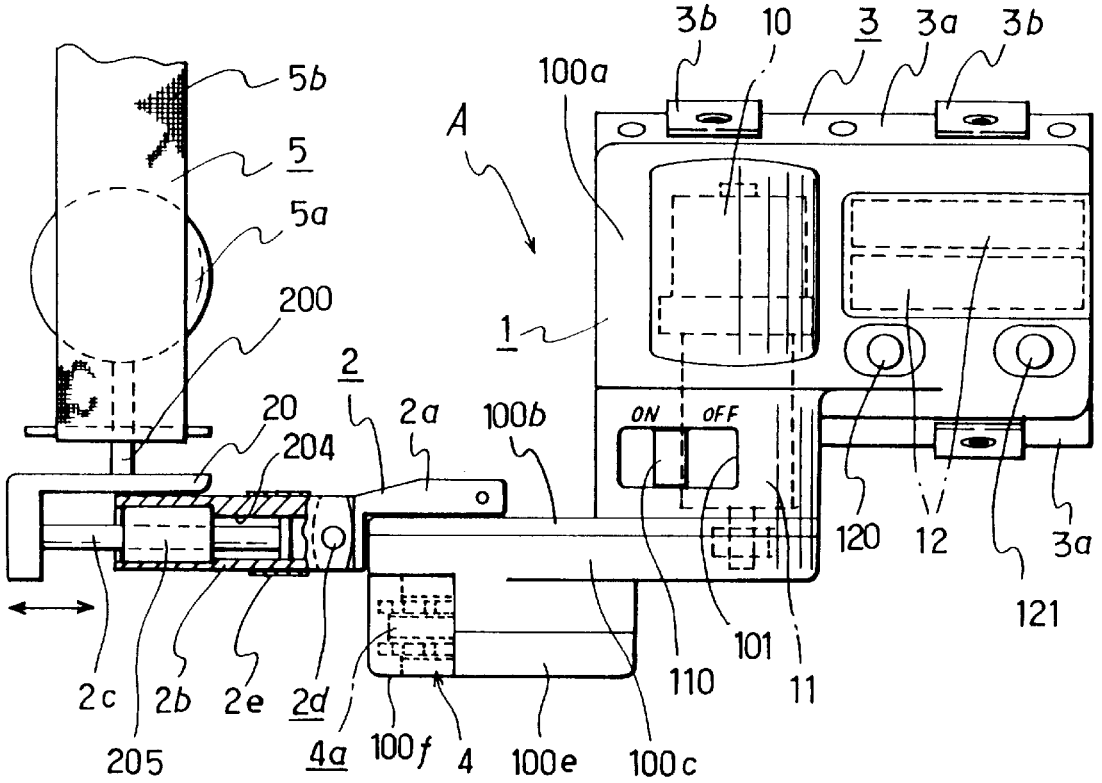
FIG. 2 is a partially cut plane view of the device in accordance with the first embodiment of the present invention.

In FIG. 1 and FIG. 2, notation A designates the invented device and notation B designates an arm rest as an assistant member. The arm rest B is used for supporting the arm attached to the invented device A.

As shown by FIG. 1 and FIG. 2, the invented device A is provided with a drive unit 1 and a swing arm 2 subjected to reciprocating swing motion with a hand joint portion as a center. In this example, the invented device A is used for carrying out a motional training of extension and flexion, and accordingly, the swing arm 2 is subjected to a reciprocating swing motion for extension and flexion.

The drive unit 1 is mounted on a mounting piece 3 which is mounted in turn to a below elbow portion in the vicinity of a joint. According to the embodiment, the mounting piece 3 is provided with a set of cushion pads 3*a* in a curved shape, and also with bands 3*b* having base portions connected to the cushion pads.

The swing arm 2 is provided with a mounting piece 5 to be located on a portion in front of a joint on its free end side. According to the example shown by FIG. 1 and FIG. 2, the mounting piece 5 is provided with a ball 5*a* that can be grasped by a user's hand and a grip hand 5*b* to assist the user to grip the ball.

Explaining in details of respective portions, firstly, the drive unit 1 is provided with a motor 10 of a reversible rotational type, a clutch 11 is connected to a side of an output shaft 111 of the motor 10 for connection and disconnection of a drive force exerted to the swing arm 2, and batteries 12 as a power source arranged in the vicinity of the motor 10 which are incorporated in cases 100*a* composed of two halves and made of synthetic resin.

The clutch 11 is formed as a mechanical clutch of a manual switching type and is provided with a clutch lever 110 for manual operation as shown by FIG. 2. The clutch lever 110 extends outwardly from an opening 101 in the case 100*a*. A power source switch 120 is connected to the batteries 12. It extends from an opening of the case 100*a* and is operated from outside. Further, an emergency switch 121 is installed, in addition to the power source switch 120, for safety purpose.

Figure 3:
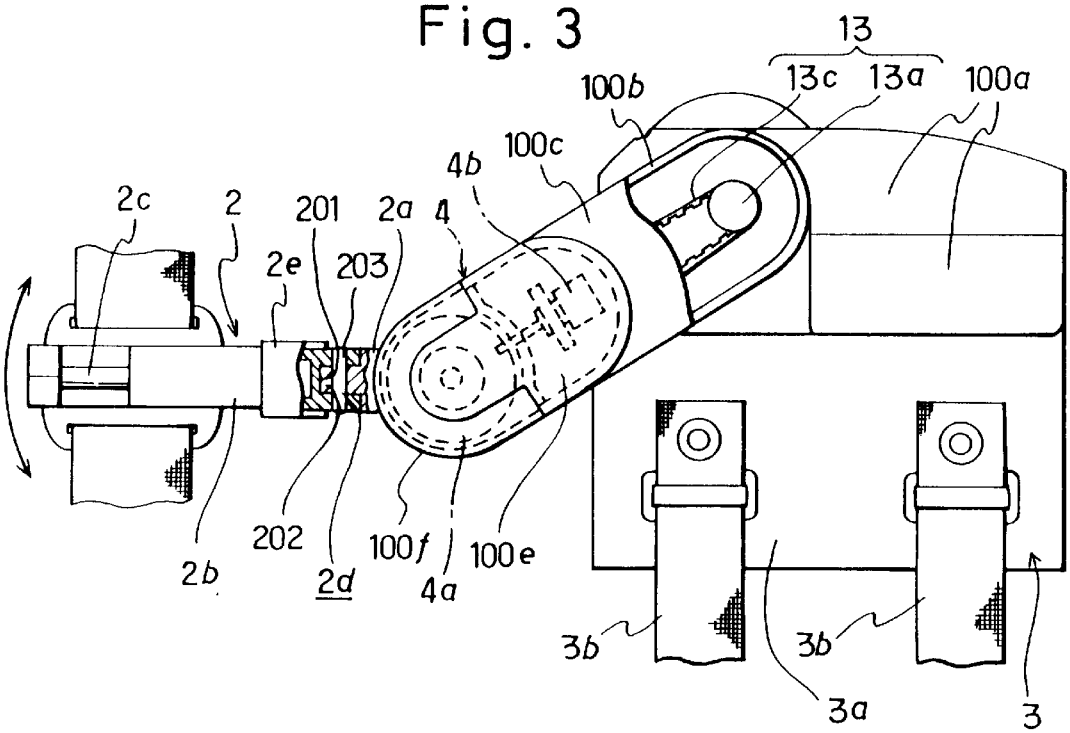
FIG. 3 is a partially cut plane view of the device in accordance with the first embodiment of the present invention.

As shown by FIG. 3, an arm-like cover (inside cover) 100*b* extending in the skew direction is integrally formed with a front end portion of the case 100*a*. As shown by FIG. 4-A, an arm-like cover (outside cover) 100*c* is fittedly attached to an opening side of the arm-like cover 100*b*, and a power transmitting means 13 constituting a portion of the drive unit 1 is incorporated in a space in a flattened shape surrounded by the arm-like covers 100*b* and 100*c*.

The power transmitting means 13 constitutes a portion of the drive unit 1 for transmitting the output of the clutch 11 to the swing arm 2 and is provided with a rotating shaft 131 for outputting at its end portion. Although a gear train mechanism or the like may be used in the power transmitting means 13, according to this example, a belt rotary mechanism is adopted for weight reduction.

As shown by FIG. 4-A, the output shaft 111 connected to the clutch, 11 is extended into the space in a flattened shape and attached to a drive pulley 13*a*. The rotating shaft 131 is pivotably supported at other end sides of the arm-like covers 100*b* and 100*c* in the longitudinal direction A driven pulley 13*b* is attached thereto and an endless belt 13c is attached between the driven pulley 13*b* and drive pulley 13*a*. As shown by FIG. 4-A, the rotating shaft 131 is projected outward from an opening provided to the arm-like cover 100*b* and its projected portion is connected with the swing arm 2

The swing arm 2 is provided with a base portion 2*a* fixed to the rotating shaft 131 projected from the arm-like cover 100*b,* a main portion 2*b* connected to the base portion 2*a* by a hinge mechanism 2*d* flexibly in a pertinent angular range, and a slider portion 2*c* held by the main portion 2*b* slidably in the axial direction. As shown by FIG. 2, a holder 20 is fixed to a front end portion of the slider portion 2*c*, and the holder 20 is fixed to a base end of a grip shaft 200 Further, the ball 5*a* for gripping is attached to the free end side of the grip shaft 200. The ball 5*a* is made of plastics hard rubber or the like.

The hinge mechanism 2*d* is capable of moving the main portion 2*b* of the swing arm 2 in a direction orthogonal to the swing face of the swing arm. As shown by FIG. 3 and FIG. 4-A, this embodiment is provided with a structure in which a front end of the base portion 2*a* and a rear end of the main portion 2*b* are provided with a grove (yoke) 201 and a projection 202 which mesh with each other, and a pivotable pin 203 extends through their central portions. Further, a sleeve-shaped locking means 2*e,* having a sectional shape the same as that of the main portion, is attached to the outer periphery of the main portion 2*b* movably in the direction of the axial line in order to prevent the main portion 2*b* from being flexed relative to the base portion 2*a* when needed.

According to example the slider portion 2*c* is provided with a shaft, The main portion 2*b* is bored with a box hole 204 from its front end in the axial direction and the box hole 204 is fixed to a guide block 205, with the shaft extending through the guide block 205 and provided with an extraction preventive stopper 206 at its rear end portion. The shaft is prevented from rotating around the axial line. This is achieved by providing spline grooves at the shaft or forming the shaft with ; section having a rectangular shape.

As shown by FIG. 4-A and 4-B, the rotating shaft 131 is extended to a side opposed to the swing arm so as to project outwardly from the arm-like cover 100*c*. The projected portion of the rotating shaft 131 and its vicinity are connected with a movable range setting copying mechanism 4 of the present invention.

The movable range setting copying mechanism 4 is operative for setting a first swing end and a second swing end by externally driving the swing arm 2. It is provided with a movable range setting dial 4*a* and a switch 4*b* for reversing a direction of driving the motor 10.

The switch 4*b* is fixedly arranged inside of a partition chamber 100*d* which is formed by the arm-like cover 100*c* close to the movable range setting dial 4*a*.

Figure 5:
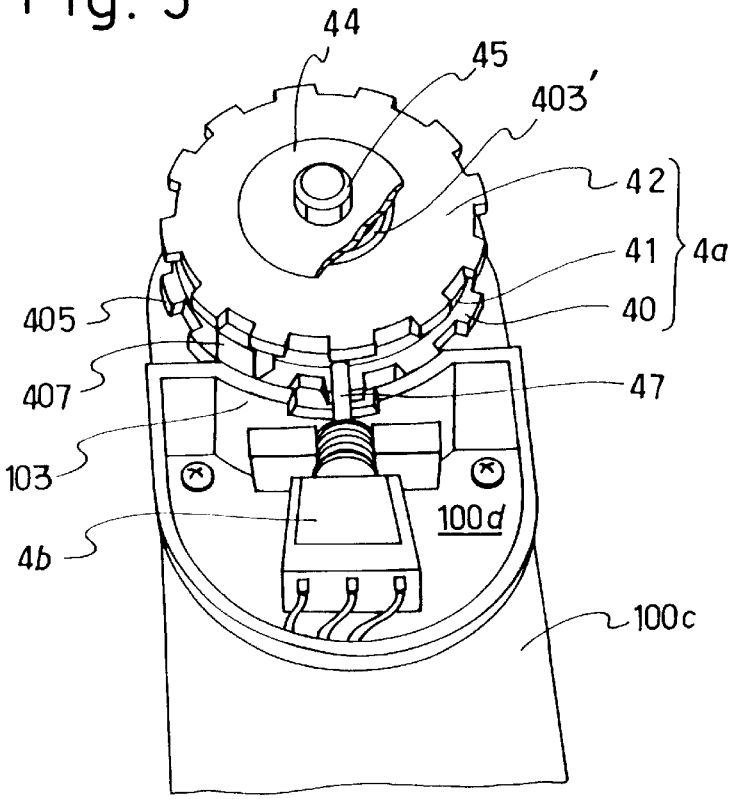
FIG. 5 is a perspective view of a movable range setting copying mechanism according to the present invention.
Figure 6:
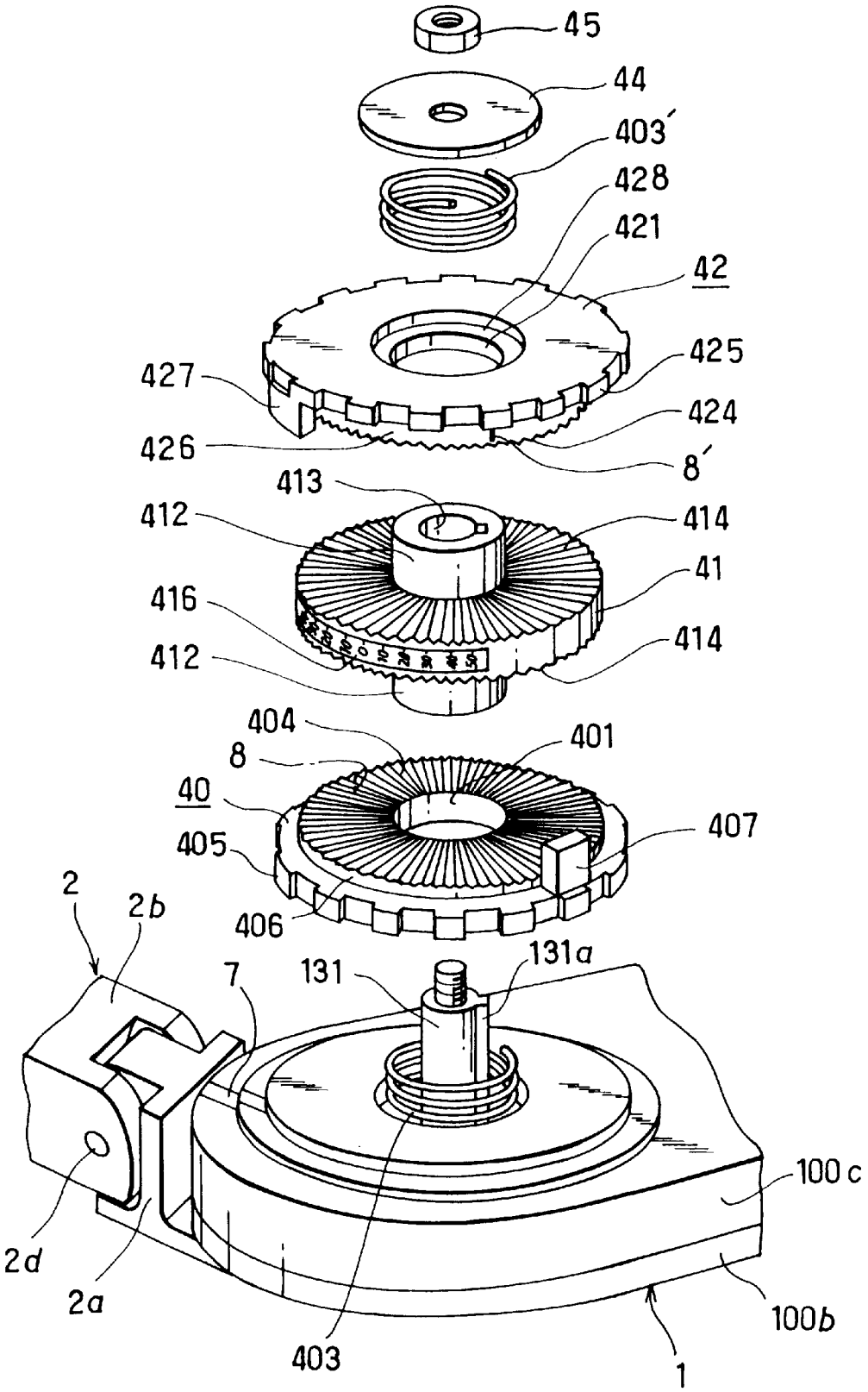
FIG. 6 is a perspective view showing the movable range setting copying mechanism according to the present invention in a disassembled state.

Details of the movable range setting dial 4*a* are shown in FIG. 4-A, FIG. 4-B, FIG. 5 and FIG. 6.

The movable range setting dial 4a comprises a first movable dial 40 for setting a first swing end (for example, flexion side), a fixing dial 41 integrally rotated with the rotating shaft 131, and a second movable dial 42 for setting a second swing end (for example, extension side). The first movable dial 40 and the second movable dial 42 are integrated in laminated layers interposing the fixing dial 41.

As shown by FIG. 4-B and FIG. 6, the fixing dial 41 has a smaller diameter than those of the first movable dial 40 and the second movable dial 42. It is provided with a number of knurlings 414 extending radially on its upper face and its lower face, and also provided with bosses 412 projected in the axial direction at its center portion. Further, a through hole 413 with a key groove is located at the inner diameter sides of the bosses 412. By fitting a key 131*a* of the rotating shaft 131 to the through hole 413, the fixing dial 41 is rotated integrally with the rotating shaft 131. An angle graduation 416 which displays the flexion side and the extension side respectively up to 50 with a boundary of, for example, a start point 0~, is attached to an outer peripheral face of the fixing dial 41.

The first movable dial 40 is disposed proximate to the outer face of the arm cover 100*c*. As shown by FIG. 4-A, FIG. 5 and FIG. 6. It has recesses and projections 405 for rotational operation formed on the outer periphery at a predetermined interval, and also a hole 401 for fitting a boss 412 of the fixing dial 41 at its center. A projected base portion 406 having a diameter substantially the same as that of the fixing dial 41 is formed on the upper face side, and knurlings 404 in mesh with the knurlings 414 are inscribed on the upper face. Further, a dog portion 407 extending upward from the projected base portion 406 is formed at an upper face edge portion of the first movable dial 40. Meanwhile, as shown by FIG. 4-B, an annular recess 408 concentric with a hole 401 is formed on its lower faces and a spring 403 with one end received by the arm-like cover 100*c* is fitted therein.

The second movable dial 42 is also formed with recesses and projections 425 for rotational operation at a predetermined interval on the outer periphery. It also has a hole 421 for fitting to the boss 412 of the fixing dial 41 at its center. Further, a projected base portion 426 having a diameter substantially the same as that of the fixing dial 41 is formed at its lower face, and knurlings 424 in mesh with the knurlings 414 of the fixing dial 41 are inscribed on the lower face of the projected base portion 426. Further, a dog portion 427 extending upward from the projected base portion 426 is formed at a lower face edge portion of the second movable dial 42.

Further, an annular recess 428 concentric with the hole 421 is installed at the upper face of the second movable dial 42, and a spring 403' is mounted in the annular recess 428.

As shown by FIG. 4-B, a receiver disk 44 is fitted to the front end portion of the rotating shaft 131, and the spring 403 is compressed via the receiver disc 44 by screwing a nut 45 to a male screw at the outer periphery of the front end of the rotating shaft 131. Thereby, the first movable dial 40 and the second movable dial 42 are pushed to the fixing dial 41 by an urging force of the two springs 403' and 403.

The main body of the switch 4*b* is fixed in a holding block projecting into the partition chamber 100*d,* and terminals at a rear portion thereof are electrically connected to a drive circuit of the motor 10 via lead wires.

The switch 4*b* is provided with a lever 47 having a flattened shape at its front end As shown by FIG. 4-A and FIG. 4-B, the lever 47 penetrates an opening provided in a partition wall 103 of the arm-like cover 100*c* and is extended toward a gap between the first movable dial 40 and the second movable dial 42. that is, the outer peripheral face of the fixing dial 41. When swing ends are to be set, the lever 47 functions as a stopper for setting the original point of the first movable dial 40 and the second movable dial 42. Further, after setting the swing ends, the lever 47 functions as an electric terminal for reversing the motor when the device is operated. As shown by FIG. 12, a signal of regular rotation or reverse rotation is sent to the drive circuit of the motor 10 when the lever 47 is brought into contact with the dog portion 407 or 427.

As shown by FIG. 6, a zero point (middle Position) indicating mark 7 is provided on the surface of the arm-like cover 100*c* and start point display portions 8 and 8' for aligning with the zero point indicating mark 7 are installed on the outer peripheral faces of the first movable dial 40 and the second movable dial 42. The zero point indicating mark 7 is constituted by a line or a band having conspicuous color, for example, yellow or red.

As shown by FIG. 3 and FIG. 4-A, the partition chamber 100*d* is provided with a lid cover 100*e*, and the lid cover 100*e* is extended to cover the nut 45 of the second movable dial 42. Further, a transparent or opaque dial cover 100*f* is attachably and detachably attached to cover the surrounding of the movable range setting dial 4*a*.

Further, although in the first embodiment the motional training of extension and flexion of hand joint is carried out by the invented device A, naturally, the invented device A can carry out motional training of radial deviation and ulnar deviation. In that case, a direction of mounting the mount piece 3 is displaced from that in FIG. 1 by 90° and the swing arm 2 faces the inside of the palm.

FIG. 8-A and FIG. 8-B show the device in accordance with an embodiment (second embodiment) in which the present invention is applied to an externally driven motion training device of an elbow joint.

The device is provided with the drive unit 1 and the swing arm 2 for carrying out reciprocating motion to provide flexion and extension centering on an elbow joint portion. The drive unit 1 is fixed to the mounting piece 3 in the vicinity of an above elbow portion and the mounting piece 5 for an below elbow portion is attached to the swing arm 2.

The driving unit 1 is basically the same as that of the first embodiment Further, the swing arm 2 is provided with the base portion 2*a* pivotably attached to the rotating shaft 131, the main portion 2*b* flexibly connected to the base portion 2*a* by the hinge mechanism 2*d* in a pertinent angular range and the slider portion 2*c* held by the main portion 2*b* slidably in the direction of an axial line similar to the first embodiment.

Further, also in the second embodiment, the rotating shaft 131 is installed with the movable range setting copying mechanism 4 for setting the first swing end and the second swing end by externally driving the swing arm 2. The movable range setting copying mechanism 4 is provided with the movable range setting dial 4*a* and the switch 4*b* in a vicinity of the movable range setting dial 4*a*. The movable range setting dial 4*a* comprises the first movable dial 40 for setting the first swing end, the fixing dial 41 integrally rotated with the rotating shaft 131, and the second movable dial 42 for setting the second swing end. Detailed structure is the same as that in the first embodiment and accordingly, an explanation thereof will be omitted.

FIG. 9-A and FIG. 9-B show the device in accordance with an embodiment (third embodiment) in which the present invention is applied to an externally driven motion training device of an ankle joint.

The device is also provided with the drive unit 1 and the swing arm 2 for carrying out reciprocating swing motion to provide flexion and extension (for example, back extension and bottom flexion) centering on an ankle joint portion. The drive unit 1 is fixed to the mounting piece 3 for a below knee portion and the swing arm 2 is installed with the mounting piece 5 for a foot portion.

The drive unit 1 and the swing arm 2 are basically the same as those in the first embodiment. The difference resides in that the main portion 2*b* is formed substantially in an L-like shape in compliance with the shape of the ankle and the foot. The vertical portion of the L-like shape is connected to the base portion 2*a* by the hinge mechanism 2*d* flexibly in a pertinent angular range and is provided with a slider portion 2*c* which is held by the main portion 2*b* slidably in the direction of the axial line. Further, the rotating shaft 131 is connected with the movable range setting copying mechanism 4 for setting the first swing end and the second swing end by externally driving the swing arm 2, similarly to the first embodiment.

Details of the drive unit 1, the swing arm; 2 and the movable range setting copying mechanism 4 are the same as of those in the first embodiment FIG. 10-A and FIG. 10-B show the device in accordance with an embodiment (fourth embodiment) in which the present invention is applied to an externally driven motion training device of a knee joint.

The device is also provided with the drive unit 1 and the swing arm 2 for subjecting the extension side and flexion side to reciprocating swing motion centering on a knee joint. The drive unit is fixed to the mounting piece 3 for an above knee portion and the swing arm 2 is installed with the mounting piece 5 for a below knee portion. The swing arm 2 is provided with the base portion 2*a* pivotably attached to the rotating shaft 131, the main portion 2*b* connected to the base portion 2*a* by the hinge mechanism 2*d* flexibly in a pertinent angular range, and the slider portion 2*c* held by the main portion 2*b* slidabey in direction of the axial line.

The drive unit 1 and the swing arm 2 are basically the same as those in the first embodiment. Further, the rotating shaft 131 is connected with the movable range setting copying mechanism 4 for setting the first swing end and the second swing end by externally driving the swing arm 2, similarly to the first embodiment. The mechanism of the movable range setting copying mechanism 4 is the same as that in the first embodiment.

Further, according to this embodiment, a holding member 8 for holding the above knee portion at near to the right angle may also be used as an assisting member.

FIG. 11-A and FIG. 11-B show the device in accordance with an embodiment (fifth embodiment) in which the present invention is applied to an externally driven motion training device of a shoulder joint.

The device is also provided with the drive unit 1 and the swing arm 2 for subjecting the extension side and the flexion side to areciprocating swing motion centering on shoulder joint. The drive unit 1 is fixed to the mounting piece 3 of a jacket type mounted on the upper half body and the slide portion 2*c*, as a top end of the swing arm 2 is attached to the mounting piece 5 for an above elbow portion.

The drive unit 1 and the swing arm 2 are basically the same as those in the first embodiment. Further, the rotating shaft 131 is connected with the movable range setting copying mechanism 4 for setting the first swing end and the second swing end by externally driving the swing arm 2, similarly to the first embodiment. The mechanism of the movable range setting copying mechanism 4 is also the same as that in the first embodiment Further, in the respective embodiments, the slider portion 2*c* of the swing arm 2 may be constituted not by a shaft but by a block, and the block may be provided with a structure where it is slidably fitted to a guide of a groove type provided in the main portion 2*b*. Further, although not illustrated in the second embodiment through the fifth embodiment, the hinge mechanism 2*d* is provided with the locking means 2*e* of a sleeve-like shape.

Next, an explanation will be given of a method of using and operation of the invented device.

After confirming that the power source switch 120 is turned OFF, the clutch lever 110 is operated to "connection" and the power source switch 120 is turned ON in this state. Thereby the output from the motor 10 is transmitted to the clutch 11 and therefore, the drive force is successively transmitted to the drive pulley 13*a,* the endless belt 13*c* and the driven pulley 13*b* via the clutch 11 and the rotating shaft 131 is rotated. Accordingly, the swing arm 2 fixed to the rotating shaft 131 is swung by an angle which is the same as that of the rotating shaft 131*e*.

When it is confirmed that such an operation is normal, the power source switch 120 is turned OFF, the clutch lever 110 is operated to "disconnection", and the mounting piece 3 is mounted to a below elbow portion. It is preferable that the rotating shaft 131 substantially coincides with the hand joint at t he mounting position. Further, the mounting piece 5 is mounted to a portion at the front portion of the joint. According to this embodiment, the ball 5*a* connect ed to the slider portion 2*c* of the swing arm 2 is lightly gripped by the palm of a patient and the hand is lightly fixed by the grip hand 5*b*.

Next, the origin point of the movable range setting dial 4*a* is set. In this case, although it is preferable to operate the clutch lever 110 to "connection" in order to hold the swing arm 2 in a state where it is directed in a constant direction as shown by FIG. 7-A without being freely moved, the clutch lever 110 may be set to "disconnection" depending theon cases. The "constant direction" 11 signifies a state in which the swing arm 2 is on a straight line on which the zero point indicating mark 7 is disposed.

In this state, the dial cover 100*f* is opened and a half region of the movable range setting dial 4*a* is exposed. Further, the second movable dial 42 is gripped and turned in the clockwise direction, and the turning is stopped when the dog portion 427 is brought into contact with one side face 470 of the lever 47 of the switch 4*b*. see FIG. 7-A)

Next, the first movable dial 40 is gripped a nd turned in the anticlockwise direction, and the turning is stopped when the dog portion 407 is brought into contact with other side face 471 of the lever 47 of the switch 4*b*. This state is shown by FIG. 7-B and signifies that the original point of swinging the dial is set. This can easily be confirmed by optically observing the positions of the origin point display portions 8 and 8' of the first movable dial 40 and the second movable dial 42. That is, the start point 0° of the angle graduation 416 aligns with the start point of display portions 8 and 8' and these are aligned with the zero point indicating mark 7.

The first movable dial 40 and the second movable dial 42 are pressed in the direction of the thickness by the springs 403 and 403' in a state where they are externally fit rotatably to the bosses 412 of the fixing dial 41. Accordingly, in setting the original point, the first movable dial 40 and the second movable dial 42 are rotated relative to the fixing dial 41 smoothly, while sliding with the knurlings 414 of the fixing dial 41 as in a ratchet.

When the origin point is set in this way, the operator operates the clutch lever 110 to "disconnection" and determines the movable range of the hand joint while supporting the hand of a patient. This is automatically set only by carrying out extension and flexion by the operator, while putting the hand of the operator on the palm of the patient and checking the condition of the patient by the operator More particularly, when the palm of the patient is bent to the extension side and the flexion side, in correspondence therewith, the swing arm 2 is swung, and also the rotating shaft 131 fixed to the base portion 2*a* of the swing arm 2 His rotated.

Therefore, first, as shown by FIG. 7-D, when the swing arm 2 is swung to the extension direction (clockwise direction), the fixing dial 41 is rotated along with the rotating shaft by a rotational angle which is the same that of the rotating shaft 131, and accordingly the first movable dial 40 in mesh with the fixing dial 41 by the knurlings 414 of the fixing dial 41 and the knurlings 404, is rotated along therewith in the clockwise direction corresponding to the extension direction. At this moment, the second movable dial 42 remains unmoved, since the dog portion 427 is brought into contact with the lever 47 and the fixing dial 41 is rotated relative to the second movable dial 42. Accordingly, the extension angle (second swing end) is automatically determined by the second movable dial 42.

Next, when the swing arm 2 is swung in the flexion direction (anticlockwise direction), the fixing dial 41 integral with the rotating shaft 131 is rotated by a rotational angle which is the same as that of the rotating shaft 131, by which the second movable dial 42 in mesh with the fixing dial 41 by the knurlings 414 of the fixing dial 41 and the knurlings 424, is rotated along therewith in the anticlockwise direction corresponding to the flexion direction. During the swinging operation in the anticlockwise direction, although the first movable dial 40 is swung along with the fixing dial 41, as shown by FIG. 7-E, in the swinging operation, the dog portion 407 is brought into contact with the lever 47 and therefore, the first movable dial 40 is not moved further Accordingly, the fixing dial 41 is rotated relative to the first movable dial 40 and therefore, the flexion angle (first swing end) is automatically set by the first movable dial 40*e*.

According to the operation of setting the movable range on the extension side and the movable range on the flexion side, the operator teaches extension and flexion movable ranges to the device by actually bending the joint of the patient. Therefore the patient suffers no pain and the optimum motional range in compliance with the state of the patient can be determined extremely simply and accurately in a short period of time.

After setting the movable range on the extension side and the movable range on the flexion side, the clutch lever 110 is operated to "connection" and the power source switch 120 is turned on. Thereby, the drive force of the motor 10 is transmitted to the rotating shaft 131 via the clutch 11, the drive shaft 111, the drive pulley 13*a,* the endless belt 13*c* and the driven pulley 13*b* and the swing arm 2 is reciprocatedly swung in the extension direction and the flexion direction by rotation of the rotating shaft 131.

In this case, when the swing arm 2 is swung in the extension direction, the second movable dial 42 is swung along with the fixing dial 41 and accordingly, the dog portion 427 is brought into contact with the lever 47. Thereby, the switch 4*b* is turned ON, a reverting signal is sent to the drive circuit of the motor 10 and the rotational direction is reversed.

Further, when the swing arm 2 is swung in the flexion direction, the first movable dial 40 is swung along with the fixing dial 41 and accordingly, the dog portion 407 is brought into contact with the lever 47. Thereby, the switch 4*b* is turned ON, a reverting signal is sent to the drive circuit of the motor 10, and the rotational direction is reversed.

Thereafter, the extension and the flexion in the movable ranges which have been set as mentioned above, is repeated in the same motion. The movable ranges are produced by directly teaching curing operation of the operator by the movable range setting copying mechanism 4 by teaching operation, the operation of the swing arm 2 reproduces the teaching operation, and accordingly, rehabilitation can be carried out without effecting unreasonable motion or pain on the patient.

Further, in actual motion, when the original extension and flexion movable ranges need to change, the power source switch 120 is turned off and the first movable dial 40 and/or the second movable dial 42 are turned manually so that the angles can be increased or decreased.

The motion of a joint of the human body is not a uniaxial, but a multiaxial rotary compound motion. Further, the patient is provided with an inherent characteristic of motion of a joint and further, the hand joint, and the position of the rotating shaft 131 do not necessarily coincide with each other. However, according to the embodiment, the swing arm 2 is provided with the slider portion 2*c,* and the slider portion 2*c* can be moved in direction of the axial line relative to the main portion 2*b*. Further, the main portion 2*b* is connected to the base portion 2*a* by the hinge mechanism 2*d,* and accordingly, the swing arm 2 can pertinently be bent in a direction orthogonal to the swing face. By these measures, the motion which correspondingly follows the motions of an actual joint of a patient can be realized and extra pain or stress is not effected on a patient or the affected portion Further, in the case where bending in a direction orthogonal to the swing face is improper for the curing operation, the locking means 2*e* in a sleeve-like shape is moved along the main portion 2*b* and is disposed in the region of the hinge mechanism 2*d*. Thereby, the pivotable pin 203 does not function as a fulcrum, the base portion 2*a* and the main portion 2*b* are integrated, and accordingly, only the sliding movement can be made feasible.

After performing the continuous extension and flexion motion training for a constant period of time, the power source switch 120 is turned off and the device is detached from the patient.

Further, although the above-described explanation relates to the extension and flexion motion training, motional training of a radial deviation and an ulnar deviation can naturally be carried out by changing the mounting position.

The operation of the inventive device in accordance with the second third, fourth and fifth embodiment is similar to that of the first embodiment.

Incidentally, when the ball 5*a* is provided, no directionality is present and accordingly, there is achieved an advantage where a grip position is not determined as in a case of a normal rod handle type, and a complicated handling such as a change of grip angle or the like is dispensed with.

What is claimed is:

1. A device for carrying out motional training by continuously flexing and extending a joint, the devise comprising a mounting piece for mounting the device in the vicinity of a joint; a drive unit arranged on said mounting piece and including a reversable rotation motor having a motor output shaft, a manual switching clutch connected to said motor output shaft, and a power transmission connected to said clutch and a transmission output rotating shaft; a swinging arm having a base portion mounted on said mounting piece and a free end portion including another mounting piece for mounting to the free end side of a front portion of the joint, said swinging arm being coupled to said transmission output rotating shaft and subjected to a reciprocating swing motion during regular and reverse rotation of said transmission output rotating shaft; a movable range setting copying mechanism operative for setting a first swing end and a second swing end of said swing arm, said movable range setting copying mechanism including a movable range setting dial located coaxially with said transmission output rotating shaft, and a switch for controlling a reverse rotation of said motor and located in the vicinity of said transmission output rotating shaft, said movable range setting dial being swung by manually moving said swing arm in a clockwise direction and an anticlockwise direction so as to specify a desired range of motion for said first swing end and said second swing end in cooperation with a portion of said switch.

2. A device as defined in claim 1, wherein said movable range setting dial includes a fixing dial rotated integrally with said transmission output rotating shaft, a first movable dial and a second movable dial both attached rotatably relative to said fixing dial, said first movable dial and said second movable dial being disposed in laminated layers interposing said fixing dial, and said switch being fixedly arranged in a vicinity of said movably arranged setting dial and including a lever extending toward said movable range setting dial at a front end of the latter, said first movable dial including a dog portion that comes into contact with a lever of said switch, while said second movable dial including a dog portion also comes into contact with said lever.

3. A device as defined in claim 2, wherein said first movable dial and said second movable dial are arranged so that said first and said second swing ends are set by said first movable dial and said second movable dial by setting an origin point by bringing said dog portion of said first second movable dial into contact with one side of said lever and bringing said dog portion of said second movable dial into contact with the other side of said lever, setting said second swing end by said second movable dial by rotating said fixing dial and said first movable dial by a same rotational angle by manually swinging said swing arm in one direction while bringing said dog portion of said second movable dial in contact with said lever to stay unmoved under a state when the original point has been set, and setting said first swing end by said first movable dial by rotating said fixing dial and said second movable dial by a same rotational angle by manually swinging said swing arm in a reverse direction and swinging said first movable dial to a limit point where said dog portion is brought into contact with said lever.

4. A device as defined in claim 2, wherein said fixing dial has a diameter which is smaller than diameters of said first movable dial and second movable dial and is projected with bosses having a through hole with a key groove at a center, said transmission output rotating shaft being fitted to said through hole, said fixing dial including knurlings provided on an upper face except at the center portion of said fixing dial, said first movable dial including a hole at a center and being fitted to a boss of said fixing dial by said hole, and inscribed with knurlings in mesh with said knurlings on said upper face opposite to said fixing dial and projected with said dog portion extending in an axial direction at an edge portion, said second movable dial including a hole and being fitted to said boss of said fixing dial by said hole, and inscribed with knurlings in mesh with said knurlings on a lower face opposite to said fixing dial and projected with said dog portion extending in an axial direction at an edge portion, said lever of said switch being extended toward a gap on inner sides of outer diameters of said first movable dial and said second movable dial.

5. A device as defined in claim 4; further comprising springs operative for urging said first movable dial and said second movable dial to be brought into close contact with said fixing dial.

6. A device as defined in claim 2, wherein said fixing dial has an outer peripheral face provided with an angle graduation of a movable range, while said first movable dial and said second movable dial have outer peripheral faces provided with start point display portions.

7. A device as defined in claim 1, wherein said swing arm has a base portion axially attached to said transmission output rotating shaft, a main portion connected to said base, and a slider portion by which said main portion is movable along an axial line, said mounting piece being connected to said slider portion.

8. A device as defined in claim 2, wherein said swing arm has a base portion axially attached to said transmission output rotating shaft, a main portion connected to said base portion flexibly by a hinge mechanism, and a slider portion held by said main portion slidingly in the direction of an axial line, said mounting piece being connected to said slider portion.

9. A device as defined in claim 8, wherein said main portion includes a locking means operative for preventing operation of said hinge mechanism.

10. A device as defined in claim 9, wherein said locking means includes a sleeve and is fitted on an outer periphery of said main portion movably in the direction of an axial line.

11. A device as defined in claim 1, wherein said mounting piece includes a ball which is grippable by a palm of a user.

12. A device as defined in claim 1; further comprising a case connected with said mounting piece and incorporating said clutch; an arm-like cover which is integrally formed with said case and defines a space in which said power transmission is incorporated; and a lid attached to said cover so that said movable range setting copying mechanism is integrated in a space produced by said cover and said lid.

13. A device for carrying out motional training by continuously bending a joint, the device comprising a mounting piece for mounting the device in a vicinity of a joint; a drive unit mounted on said mounting piece and including a reversible motor having a motor output shaft, a manual switching clutch connected with said motor output shaft, and a power transmission connected to said clutch and a transmission output rotating shaft; a swing arm having a base portion mounted on said mounting piece and a free end portion including another mounting piece for mounting on the free end side of a front portion of the joint, said swing arm being coupled to said transmission output rotating shaft and subjected to a reciprocating swing motion by said transmission output rotating shaft which rotates regularly and reversibly; a movable range setting copying mechanism for setting one side swing end and another side swing end of said swing arm, said movable range setting copying mechanism including a movable range setting dial attached to said transmission output rotating shaft and a switch installed in a vicinity of said transmission output rotating shaft for reversing a direction of driving of said motor, said movable range setting dial including a fixing dial rotated integrally with said transmission output rotating shaft, a first movable dial and a second movable dial both attached to said fixing dial rotatably relative to said fixing dial, said first movable dial and said second movable dial being located above and below to interpose said fixing dial, said first movable dial including a dog portion that comes into contact with a lever of said switch while said second movable dial including a dog portion that comes into contact with the lever, said switch being fixedly arranged in the vicinity of said movable range setting dial and including said lever, said lever being extended toward a gap at inner sides of outer diameters of said first movable dial and said second movable dial.

* * * * *